US011261730B2

(12) United States Patent
AlBahrani et al.

(10) Patent No.: US 11,261,730 B2
(45) Date of Patent: Mar. 1, 2022

(54) WELLBORE FAILURE ANALYSIS AND ASSESSMENT

(71) Applicant: Saudi Arabian Oil Company, Dhahran (SA)

(72) Inventors: Hussain AlBahrani, Qatif (SA); Osman Hamid, Houston, TX (US); Adel AlQahtani, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 615 days.

(21) Appl. No.: 16/036,363

(22) Filed: Jul. 16, 2018

(65) Prior Publication Data

US 2020/0018160 A1 Jan. 16, 2020

(51) Int. Cl.
*E21B 49/00* (2006.01)

(52) U.S. Cl.
CPC ..... *E21B 49/006* (2013.01); *E21B 49/003* (2013.01)

(58) Field of Classification Search
CPC ..... E21B 49/006; E21B 48/003
USPC ..... 703/10
See application file for complete search history.

(56) References Cited

U.S. PATENT DOCUMENTS

| | | | | |
|---|---|---|---|---|
| 4,287,946 | A | 9/1981 | Brieger | |
| 4,589,504 | A | 5/1986 | Simpson | |
| 4,776,410 | A | 10/1988 | Perkin et al. | |
| 5,574,371 | A | 11/1996 | Tabanou et al. | |
| 5,842,149 | A * | 11/1998 | Harrell | E21B 44/00 702/9 |
| 6,164,126 | A | 12/2000 | Ciglenec et al. | |
| 7,114,562 | B2 | 10/2006 | Fisseler et al. | |
| 9,874,806 | B2 | 1/2018 | Takahara et al. | |
| 10,088,725 | B2 | 10/2018 | Umezaki | |
| 10,400,570 | B2 * | 9/2019 | Erge | E21B 47/00 |
| 2004/0221985 | A1 | 11/2004 | Hill et al. | |
| 2012/0123756 | A1 * | 5/2012 | Wang | E21B 44/00 703/2 |
| 2014/0116776 | A1 * | 5/2014 | Marx | E21B 47/00 175/24 |
| 2016/0076357 | A1 * | 3/2016 | Hbaieb | E21B 44/00 702/9 |

(Continued)

OTHER PUBLICATIONS

International Search Report and Written Opinion issued in International Application No. PCT/US2019/041929 dated Oct. 23, 2019, 18 pages.

(Continued)

*Primary Examiner* — Bijan Mapar
(74) *Attorney, Agent, or Firm* — Fish & Richardson P.C.

(57) ABSTRACT

Methods, systems, and apparatus, including computer programs encoded on a computer storage medium, for improving wellbore stability and minimizing wellbore failure issues. In one aspect, a method includes receiving, for a well site, post-drilling parameters; clustering the received post-drilling parameters into groups based on an information type of each post-drilling parameter; generating a correlation model by applying a numerical analysis or a statistical analysis to the post-drilling parameters included in each of the groups; determining a resolution to avoid wellbore failure at a new well site by processing information regarding the new well site through the correlation model; and transmitting the resolution for implementation at the well site.

20 Claims, 5 Drawing Sheets

(56) References Cited

U.S. PATENT DOCUMENTS

2018/0051548 A1* 2/2018 Liu ..... E21B 7/28
2018/0119535 A1* 5/2018 Shen ..... E21B 44/00

OTHER PUBLICATIONS

Adham, "Geomechanics model for wellbore stability analysis in Field 'X', North Samatra Basin," retrieved from URL <https://mountainscholar.org/bitstream/handle/11124/17O314/Adham_mines_0O52N_llO59.pdf?sequence=l>, Jan. 1, 2016, 121 pages.
Albukhari et al., "Geomechanical Wellbore Stability Analysis for the Reservoir Section in J-NC186 Oil Field," retrieved from URL <https://www.onepetro.org/down1oad/conference-paper/ISRM-TUNIR0CK-2018-22?id=conference-paper/ISRM-TUNIROCK-2018-22>, retrieved on Oct. 14, 2019, published Mar. 31, 2018, 15 pages.
Al-Haidary, "Wellbore Stability Assessment in a Shale Formation," retrieved from URL <http://eprints.kfupm.edu.sa/139181/1/Wellbore_Stability_Assessment_in_a_shale_formation_Saleh_AlHaidary.pdf>, retrieved on Oct. 14, 2019, published May 1, 2014, 136 pages.
Alsubaih, "Shale instability of deviated wellbores in southern Iraqi fields," retrieved from URL <http://scholarsmine.mst.edu/cgi/viewcontent.cgi?article=8544&context=masters_theses>, retrieved on Oct. 14, 2019, published Jan. 1, 2016, 129 pages.
Kosset, "Wellbore integrity analysis for wellpath optimization and drilling risks reduction: the vaca muerta formation in neuquen basin," retrieved from URL <https://mountainscholar.org/bitstream/handle/11124/464/Kosset mines_0O52N_lO469.pdf? sequence=l&isAllowe3=y>, published Jan. 1, 2014, 131 pages.
Lang et al., "Wellbore Stability Modeling and Real-Time Surveillance for Deepwater Drilling to Weak Bedding Planes and Depleted Reservoirs," SPE, Mar. 1, 2011, 18 pages.
Li et al., "Pore-pressure and wellbore-stability prediction to increase drilling efficiency," Journal of Petroleum Technology, Feb. 28, 2012, 4 pages.
Tan et al., "Wellbore Stability of Extended Reach Wells in an Oil Filed in Sarawak Basin, South China Sea," SPE Proceedings, XX, XX, SPE88609, Oct. 18, 2004, 11 pages.
Tutuncu et al., "Annual Meeting Selections. Integrated Wellbore-Quality and Risk-Assessment Study Guides Successful Drilling in Amazon Jungle," Geophysics, Society of Exploration Geophysics, vol. 71, No. 6, Jan. 1, 2006, 7 pages.
U.S. Appl. No. 10/334,437, filed Dec. 31, 2002, Hoteit et al.
U.S. Appl. No. 12/974,759, filed Dec. 21, 2010, Sadlier et al.
GCC Examination Report in GCC Appln. No. GC 2019-37931, dated Sep. 30, 2020, 4 pages.

* cited by examiner

WELLBORE FAILURE ANALYSIS AND ASSESSMENT

TECHNICAL FIELD

This disclosure relates to methods, systems, and apparatus for improving wellbore stability and minimizing wellbore failure issues.

BACKGROUND

Well drilling is the process of drilling a hole in the ground for the extraction of a natural resource such as ground water, brine, natural gas, or petroleum, for the injection of a fluid from surface to a subsurface reservoir or for subsurface formations evaluation or monitoring. A wellbore is the actual hole that forms the well and is drilled to, for example, provide access to or aid in the exploration and recovery of the sought after natural resource(s). A wellbore includes the open hole and can be encased by materials such as steel and cement, or it may be uncased. A borehole may refer to the inside diameter of the wellbore wall, the rock face that bounds the drilled hole.

SUMMARY

The present disclosure describes methods and systems, including computer-implemented methods, computer-program products, and computer systems for improving wellbore stability and minimizing wellbore failure issues by analyzing drilling performance in terms of wellbore failure in the post drilling stage of various well sites by employing a correlation model generated with clustered and weighted failure influences.

In a general implementation, post-drilling parameters for a well site are received. These post-drilling parameters are clustered into groups based on an information type of each post-drilling parameter. A correlation model is generated by applying a numerical analysis or a statistical analysis to the post-drilling parameters included in each of the groups. A resolution to avoid wellbore failure at a new well site is determined by processing information regarding the new well site through the correlation model. The resolution for implementation is transmitted at the well site Implementations include a wellbore stability system to improve wellbore stability. For example, implementations of the described wellbore stability system may be used to identify the root causes of wellbore failure, hole enlargement, and poor hole conditions in the post drilling stage. Additionally, implementations of the described system may generate cutoff values and limits, such as thresholds, for critical parameters, which can serve to minimize wellbore failure issues and enhance hole conditions. The described system may also provide real-time advisory actions during the drilling process by monitoring critical parameters and issuing recommendations to, for example, enhance hole conditions.

The details of one or more implementations of the subject matter of this specification are set forth in the accompanying drawings and the later description. Other features, aspects, and advantages of the subject matter will become apparent from the description, the drawings, and the claims.

DETAILED DESCRIPTION

Figure 1:
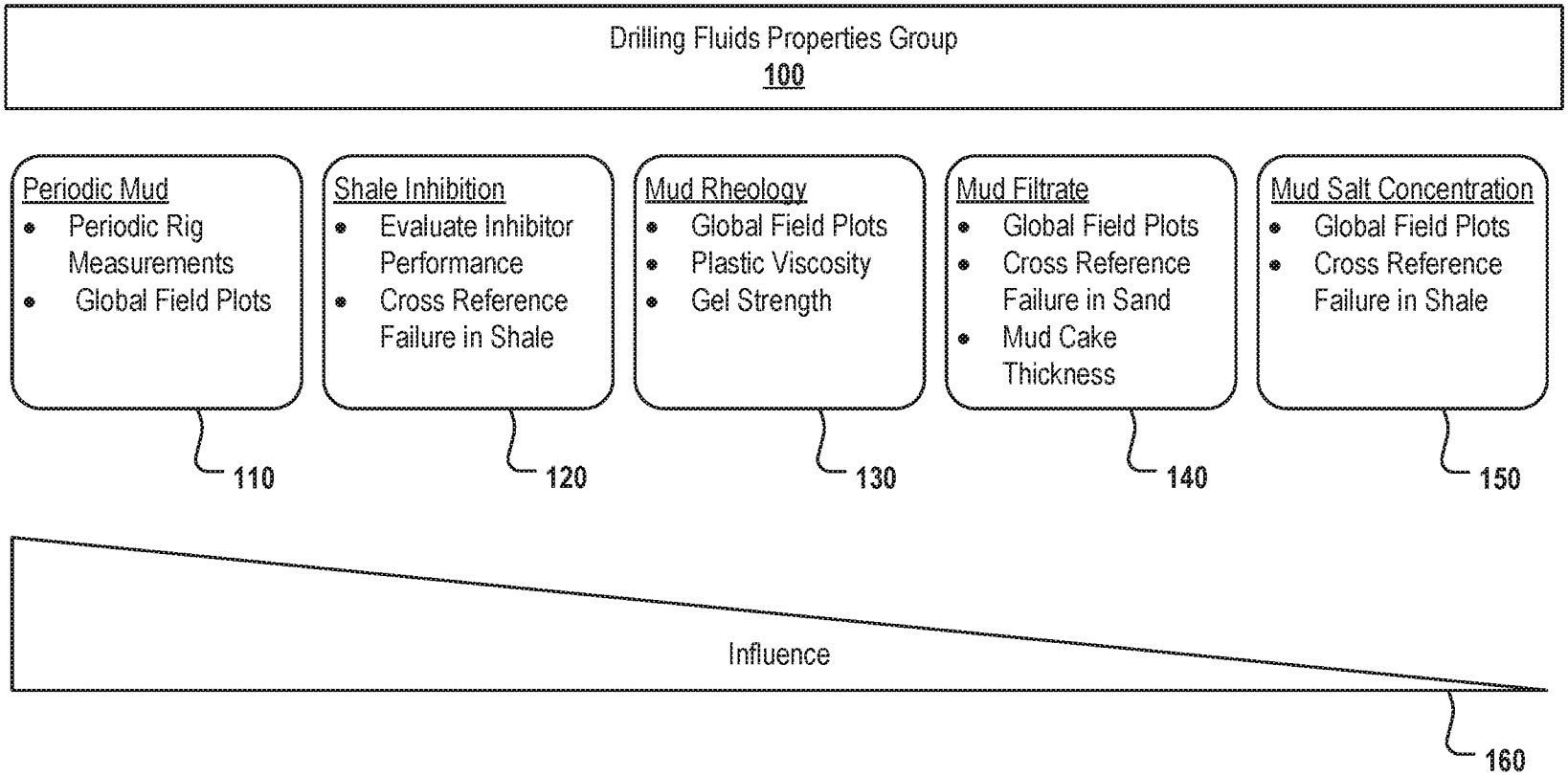
FIG. 1 illustrates a block diagram of information that can be clustered by the described wellbore stability system into the drilling fluid properties group.

This disclosure generally describes a wellbore stability system for improving wellbore stability and minimizing wellbore failure by evaluating drilling performance in terms of wellbore failure in the post drilling stage by employing a correlation model generated with clustered and weighted failure influences. The disclosure is presented to enable any person skilled in the art to make and use the disclosed subject matter in the context of one or more particular implementations. Various modifications to the disclosed implementations will be readily apparent to those skilled in the art, and the general principles defined herein may be applied to other implementations and applications without departing from scope of the disclosure. Thus, the present disclosure is not intended to be limited to the described or illustrated implementations, but is to be accorded the widest scope consistent with the principles and features disclosed herein.

Wellbore failure, hole enlargement, or both are problems that may arise during drilling. The causes of wellbore instability are often classified into either mechanical that may arise from failure of the rock around the hole due to, for example, high stresses, low rock strength, or inappropriate drilling practice or chemical effects that may arise from damaging interaction between the rock, generally shale, and the drilling fluid. Failure and hole enlargements can jeopardize the well objectives as they can lead to poor hole conditions. These poor hole conditions could mean, for example, that certain downhole measurements and logging runs are no longer feasible. Wellbore failure can also put a well at greater risk of, for example, stuck pipe incidents and sidetracking. Furthermore, as gas wells are frequently subjected to high-pressure stimulation jobs, wells with instability issues are prone to developing casing-casing annular (CCA) or tubing-casing annular (TCA) pressure, which is one of the major causes of locked potential. Causes of wellbore instability may include aggressive reaming and lateral cyclic loading exerted by the drill string on the wellbore wall that aggravates the shear failure of rocks. In some cases, insufficient drilling fluid weight may also be a contributing cause. Other causes can include various properties of drilling fluid and wellbore deviation or doglegging.

For example, gas wells may show a variable performance and results in terms of wellbore stability during the drilling of reservoir sections as some wells may be drilled successfully with no issues relating to stability, while others do experience instability issues even though they are drilled in the same areas as the successful wells. The instability issues in these failed wells may lead to poor hole conditions, which cause the cancellation of the logging run. Furthermore, wells that experience instability issues during drilling can put the objectives for drilling he well under an increased risk as the wells are susceptible to experiencing incidents, such as stuck pipes, which may cause the project to be sidetrack.

Another major risk associated with instability issues is the potential for CCA and TCA development. For example, poor hole conditions resulting from instability may lower the quality of cementing jobs. As such, the chances of developing CCA or TCA pressure increase tremendously when combined with a lower quality cement job. Considering that CCA and TCA issues are a major cause for locked potential, the issue of instability is of high concern.

In view of the forgoing, the described wellbore stability system is employed to improve wellbore stability and minimize wellbore failure, such as hole enlargements and hole collapse. The system can be employed to evaluate the drilling performance in terms of wellbore failure in the post drilling stage as well as to generate recommendations for avoiding wellbore failure in the well planning stage. Additionally, the system may also minimize issues resulting from wellbore failure, such as, stuck-pipe incidents, sidetracking, unreliable downhole measurements, poor cementing jobs, CCA and TCA pressure, and difficulties in setting packers for fracking operations. In some implementations, the described wellbore stability system employs workflow and the clustering procedures to examine related factors each with the potential to influence wellbore stability. These factors may be related to the drilling fluid, a group of drilling or operational practices, or formation rock properties. By employing these factors, the system can identify the root cause(s) for wellbore failure, hole enlargement, poor hole conditions, or all three in the post drilling stage. Furthermore, the system may generate cutoff values and limits for critical parameters in the planning stage, which can serve to minimize wellbore failure issues and enhance hole conditions. The system also provides real-time advisory during the drilling process by, for example, monitoring the critical parameters and issuing recommendations to enhance hole conditions.

The relationship between time and wellbore stability includes the result of two main phenomena that take place in the openhole during the drilling process. The first phenomenon includes the charging of the local (near-wellbore) pore pressure as a result of the pressure overbalance and the drilling fluids filtration. Based on Terzaghi's principle of effective stress and in accordance with the theory of poroelasticity, the increase in pore pressure may generally lead to a reduction in the stresses controlling rock failure. An increase in the openhole exposure times to drilling fluids is expected to create more charging of the local pore pressure, and hence, will exacerbate instability issues by reducing shear resistance. This reduction in shear resistance may be due to a collective reduction of all induced stresses supporting the wellbore rock. Induced stresses, such as hoop, radial, and axial stresses, can be affected by the charging of the local pore pressure from mud filtration. Other considerations, such as the formation permeability and the creation of mud cake, can alter the response of pore pressure to the drilling fluid exposure. Furthermore, formations with low permeability rock or wellbores with low permeability mud cakes can reduce the charging of the local pore pressure. This will consequently cause minimal reduction in the effective stresses leading to smaller reduction in shear resistance. It is due to this effect that wellbores in low permeability formations will experience low shear failure and enlargements.

The second main phenomenon affecting the time dependency of wellbore stability is heat exchange. Due to, for example, the geothermal gradient, there is a temperature difference between the circulating drilling fluid and the formation. Therefore, apart from very shallow formations, the temperature of wellbore wall rock is higher than that of the circulating drilling fluids. Consequently, a heat exchange process takes place where the circulating fluid will work to cool the wellbore wall. The result of this heat exchange process varies due to the other factors, such as the formation permeability and thermal expansion coefficient. Wellbores drilled in formations with high thermal expansion coefficient, and to a lesser extent high permeability, will experience contraction as a result of cooling. The contraction of the rock grains in the wellbore wall will cause a relief to the hoop stress. Unlike the case with the charging of the local pore pressure, the relief resulting from cooling and contraction will affect the hoop stress but not the other induced stresses. A reduction in the hoop stress alone may increase the shear resistance of the rock and will consequently reduce the chances of enlargements.

The described wellbore stability system analyzes and characterizes wellbore failure in the post drilling stage by clustering the failure influences into groups, such as drilling fluid properties, operational parameters, and formation mechanical properties. Additionally, the system details the source of data used to analyze the failure. Such information may be used in the pre-drilling analysis stage to evaluate and influence the reduction of wellbore failure and enlargements and in the post drilling analysis stage. For example, the system may obtain and employ information regarding well formation tops and other basic well information, such as hole sections depths, drilling rigs names, and drilling durations. Additionally, periodic review of well operations may be analyzed within the describe system for applicable drilling events to identify trends for various regions and areas for drilling. The system may also use information related to drilling fluids, such as the consumption of certain drilling fluids, which may be taken from, for example, well site reports and documentation, such as daily reports of drilling fluid types and properties collected about each well site. Historical data from post drilling reports as well as real-time data for each well may also be used. Analysis of the information from the post drilling reports and real-time data may include, for example, applicable trends in drilling parameters and time durations spent performing certain actions relating to instability, such as reaming and lithology interpretations. Other information analyzed and employed by the system may be obtained through the wellbore deviation surveys, post drilling or completion reports relating to each well history as well as acoustic, density, porosity, gamma rays, and caliper logs data for each well.

As used herein, the term "real-time" refers to transmitting or processing data without intentional delay given the processing limitations of a system, the time required to obtain data, and the rate of change of the data. In some examples, "real-time" is used to describe the analysis and determination of solution by the described wellbore stability system.

This described system analyzes the information presented earlier to provide quantifiable predictions of wellbore failures. In some implementations, the system generates a correlation model based on an analysis of the collected information. Once generated, the model can be employed to predict wellbore failure based on a quantification value, such as relating to caliper measured enlargements. This information may then be used in, for example, the well planning phase to determine thresholds for the various parameters, such as drilling fluid and operational practices, and to ensure minimal wellbore failure and enlargements In some implementations, the correlation model can be generated based on the clustering and weighting of related parameters. As mentioned earlier, related parameters may be clustered into groups, such as drilling fluid properties, operational parameters, and formation mechanical properties. The correlation model may be employed within the described wellbore stability system to identify trends within each cluster and to predict wellbore failure using the identified trends from each cluster. In some implementations, the correlation model employs statistical analysis methods, such as multiple regression; weighted output, such as trends; or both of the clusters, to predict overall wellbore failure. In some implementations, field and formation specific regressions are performed for each cluster to generate the correlation model for wellbore failure. For example, based on the trends observed for each of the field and formation regressions, the output of each cluster may be assigned with a coefficient of weight that is used to estimate the overall anticipated wellbore failure.

FIG. 1 illustrates a block diagram of information that can be clustered by the described wellbore stability system into the drilling fluid properties group 100. The drilling fluid property group 100 includes categories for periodic drilling fluid or "mud" readings 110, shale inhibition 120, mud rheology 130, mud filtrate 140, and mud salt concertation 150. The influence indicator 160 depicts the amount of influence each of these categories has in the overall determination of the indications for wellbore stability, where periodic drilling fluid readings 110 have the most influence, such as values and properties are weighted the most heavily, down to salt concertation 150, such as value and properties weighted the least. However, influence of each category may vary from case to case. Accordingly, the order of categories may change based on the model built for each field or area. The described wellbore stability system may factor this influence through, for example, weighted values, multiple regressions modeled, or both through a generated correlation model.

Periodic drilling fluid readings 110 include data collected periodically regarding the drilling fluid at various well sites. Drilling fluid is used to aid the drilling of boreholes and liquid drilling fluid is often referred to as drilling mud. Drilling fluids can be categorized into three main categorizes: water-based muds, which can be dispersed and non-dispersed; non-aqueous muds, usually referred to as oil-based mud or invert; and gaseous drilling fluid, in which a wide range of gases can be used. Functions of these drilling fluids include providing hydrostatic pressure to prevent formation fluids from entering into the well bore, keeping the drill bit cool and clean during drilling, carrying out drill cuttings, suspending the drill cuttings while drilling is paused and when the drilling assembly is brought in and out of the hole, and so forth.

While drilling, readings 110 may be collected periodically regarding the mud from various well sites. These readings can include measurements of the drilling fluid density. For example, the drilling fluid used in each well site is sampled and a density measurement is performed on a daily basis, such as the daily mud weight measurements).

This information may be used in the post drilling stage by the described system to generate the correlation model. For example, a global field plot may be generated. A global field plot is a combination of the drilling fluids density measurements performed on wells sites in a specific field. The plot of these measurements can be analyzed against the wellbore enlargements experienced in the said field. This analysis aims to identify any relevant trends or behaviors in the relationship between the drilling fluid density and the observed wellbore enlargement as drilled wellbores required a certain drilling fluid density for support. This fluid density support will work to reduce the chance of wellbore enlargements during the drilling process.

The shale inhibition category 120 includes readings regarding the shale inhibitors used at various well sites. When encountering shale during drilling operations, water in the drilling fluid may interact with the materials, such as clay, within the formation, causing the shale to swell. This swelling can lead to instability in the wellbore, and dispersion of shale into the drilling fluid (sloughing), which may eventually lead to hole washout. A shale inhibitor may prevent or slow down this process. Shale inhibitors may have differing degrees of molecular weight, ionicity, and product forms to cater to the various well conditions and fluid systems. For the shale inhibition category 120, measurements and evaluations of the performance of shale inhibitors from well sites may be taken. Such information may include the type (including a commercial name if applicable) of the shale inhibition material used, the composition of the shale inhibition material used, and the concentration of the shale inhibition used within the drilling fluid. This information is based on, for example, daily reports of drilling fluids composition from each well site within the targeted field and may be cross-referenced with failures in shale at the respective well sites to build the correlation model.

Rheology is the study of how matter, such a drilling fluid, deforms and flows. As such, the mud rheology category 130 includes readings regarding the mud used on the various well sites. Such reading may include information regarding the viscosity and gelation of the mud. For example, the information and measurements provided in this step are of the drilling fluid rheology, which may include a measurement of plastic viscosity and gel strength of the mud. The same procedure followed in the global field plots for the drilling fluid density (mud weight) can be followed here. Here, a global field plot is a combination of all of the drilling fluids rheology measurements performed on all wells sites in a specific field. The plot of these measurements is analyzed against, for example, the wellbore enlargements experienced in the said field. This analysis aim to identify any relevant trends or behaviors in the relationship between the drilling fluid density and the observed wellbore enlargement.

Plastic viscosity (PV) is the slope of the shear stress or shear rate line above a yield point. PV represents the viscosity of a mud when extrapolated to an infinite shear rate on the basis of the mathematics of the Bingham model. Another relevant measurement is the gel strength or the shear stress of drilling mud. Gel strength may be measured at a low shear rate after the drilling mud is static for a certain period of time and is an important drilling fluid properties because it demonstrates the ability of the drilling mud to suspend drill solid and weighting material when circulation is ceased.

The mud filtrate category 140 includes readings regarding the liquid part of the mud used on the various well sites. Mud filtrate can pass through a medium and become separated from the mud cake. The mud cake includes the layer of particulates from the drill mud coating the inside of the borehole. The mud filtrate may continue to invade the porous and permeable formation until the solids present in the mud, commonly bentonite, clog enough pores to form a mud cake capable of preventing further invasion. Such information may include separate measurements. These measurements are performed on a periotic basis on each well site. These measurement can include volume of spurt mud filtration measured at high pressure and high temperature (HPHT) conditions, total volume of mud filtration measured at HPHT conditions, thickness of mud cakes produced during the HPHT test, measurement of the filtration spurt volume using a device known as "Particle Plugging Apparatus" under HPHT conditions, and measurement of the total filtration volume using the Particle Plugging Apparatus under HPHT conditions. These parameters can be analyzed separately against the wellbore enlargements experienced in all the wells within the field, such as the global field plots. The collected rheology information may be cross-referenced with failures in the sand from the various well site in generating the correlation model.

The mud salt concertation category 150 includes readings regarding the non-liquid part of the mud used on the various well sites. Salt, such as, for example, sodium chloride (NaCl), or contamination may be a result of salty makeup water, drilling salt stringers, or saltwater flows. For example, saltwater-based drilling fluids are used when salt is drilled in large quantities or where salty makeup water is used. Such information may include a concentration of the chloride ($Cl^-$) ion in the drilling fluid and the clay content (or presence of shale intervals) within the drilled formation rocks. The chloride concentration and the clay content of the drilled formation rock may be taken from, for example, Global Field Plots. Furthermore, as mentioned previously, this data is collected from each well site within the targeted field and then is analyzed in a combined (global) plot against the experienced wellbore enlargements. The mud salt concertation information may be cross-referenced with failures in the shale from the various well site in generating the correlation model.

Figure 2:
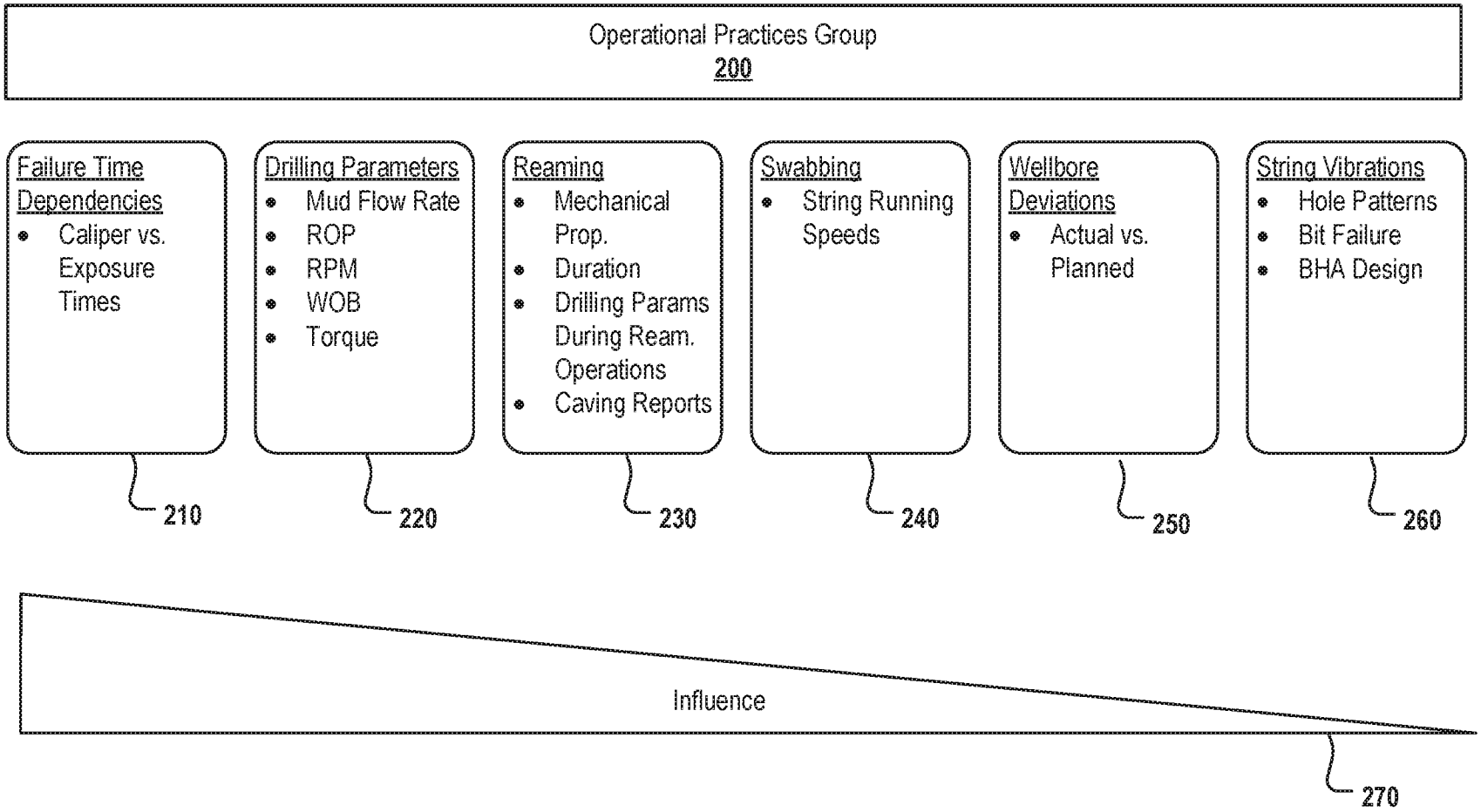
FIG. 2 illustrates a block diagram of information that can be clustered by the described wellbore stability system into the operational practices group.

FIG. 2 illustrates a block diagram of information that can be clustered by the described wellbore stability system into the operational practices group 200. The operational practices group 200 includes categories for failure time dependencies 210, drilling parameters 220, reaming 230, swabbing 240, wellbore deviations 250, and drill string vibrations 260. The influence indicator 270, similar to influence indicator 160 of FIG. 1, depicts the amount of influence each of these categories has in the overall determination of the indications for wellbore stability, where failure time dependencies 210 has the most influence, such as where values and properties are weighted the most heavily, down to string vibrations 260, such as where value and properties weighted the least. However, influence of each category, like the drilling fluid properties group, may vary from case to case. Accordingly, the order of categories may change based on the model built for each field or area. The described wellbore stability system may factor this influence through, for example, weighted values, multiple regressions, or both modeled through a generated correlation model.

The failure time dependencies category 210 includes data collected regarding the exposure time of the open wellbore to the drilling fluids, changes in size or diameter of the wellbore with time, or both. For example, hole closure is a narrowing time-dependent process of borehole instability that may eventually lead to hole enlargement. Hole closure may be referred to as creep due to the in-situ stresses. Problems associated with hole closure include increase in torque and drag, increase in potential pipe sticking, and increase in the difficulty of casings landing. Another example is the invasion of the drilling fluid filtration into the wellbore rock due to prolonged exposure times. The invading filtration will cause the wellbore rock to fail if allowed to proceed for prolonged periods of time. Data collected about these issues as well as caliper log data regarding the borehole shape and diameter cross reference according to exposure times at the respective well site may be categorized in this group. Additional readings collected in this group can include the open hole exposure times to drilling fluids. These time durations are measured and classified into intervals, which can include open hole exposure time while drilling or rotating, open hole exposure time while remaining stationary before reaching the targeted depth, and open hole exposure time while remaining stationary after reaching the targeted depth. Other readings collected in this group can include the length of the drilled intervals, the permeability measurements of the drilled interval rock, and the temperature measurement of the both the drilling fluids and the downhole drilled formation rock.

The drilling parameters category 220 includes data collected regarding various drilling parameters at various well sites. These drilling parameters may include data collected regarding mudflow rate measured in, for example, gallons per minute (GPM), rate of penetration (ROP), revolutions per minute (RPM) of the drill string, weight applied on the drill bit (WOB), and Torque. ROP is the speed at which a drill bit breaks the rock under it to deepen the borehole.

The reaming category 230 includes data collected regarding the reaming performed at various well sites. To enlarge a wellbore, reaming may be necessary for several reasons. For example, if a hole was not drilled as large as it should have been at the outset. This can occur when a bit has been worn down from its original size, but might not be discovered until the bit is tripped out of the hole, and an under gauge hole has been drilled. Plastic formations may also slowly flow into the wellbore over time, requiring the reaming operation to maintain the original hole size. Additionally, reaming may be performed to smooth the walls of a hole. Reamers, which are edge-cutting tools, may be used for reaming a hole.

Readings collected in this group can include mechanical properties, reaming duration, drilling parameters, and caving reports. Reading regarding mechanical properties can include an estimation of the drilled formation mechanical properties made based on, for example, logging data. This logging data can be taken from a tool that is run into each wellbore. Reaming duration is the time spent performing reaming operations in the wellbore. This data can be categorized based on the type of the reaming operations performed. Such categories can include forward reaming duration, back reaming duration, and reaming on connections. Drilling parameters during reaming operations include measurements of the torque experienced by the drill string during reaming. Caving reports are reports that can be made by individuals on the rig site and detail, for example, un-usually sized rock cuttings, the size of the caving collected at the surface, the lithology of the cavings, and the depth from which the caving originated. For example, the rock cutting produced by the drill bit downhole are transported to the surface using the drilling fluids. These cuttings are expected to be of a certain size and dimensions depending on the type of drill bit used and formation drilled. When an un-usually sized cutting (caving) reaches the surfaces, it is reported as it might indicate a failure of the formation rock to causes other than the drill bit. The size of the caving collected at the surface, the lithology of the cavings, and the depth from which the caving originated.

The swabbing category 240 includes data collected regarding swabbing performed at various well sites. Swabbing is the momentary reduction of the wellbore hydrostatic pressure due to the pulling out of the drill string from the wellbore at elevated speeds. For example, when a string is pulled out of the well, it creates a temporary reduction in bottom hole pressure. If the hydrostatic pressure reduction is large enough to create underbalanced conditions, the well will eventually flow. If the hydrostatic pressure reduction is large enough to fall below the level required for wellbore support, the wellbore wall rock will eventually fail and create hole enlargements. The reduction in hydrostatic pressure to cause the well to flow is bigger than the reduction that will cause enlargement. Therefore, enlargements are easier and more common to occur. Data collected about the string running speeds as well as other readings that can include the dimensions of the drill string (inside and outside diameters of the different tubulars used in the drill string) and the diameter of the drill bit may be categorized in this group.

The wellbore deviations category 250 includes data collected regarding deviations in the wellbore or borehole at various well sites. Hole deviation is the unintentional departure of the drill bit from a preselected borehole trajectory. For example, wellbore deviations may include deviations of the angle at which a wellbore diverges from vertical. Wells can also be deliberately deviated by the use of, for example, a whipstock or other steering mechanism. For example, wells are often deviated or turned to a horizontal direction to increase exposure to producing zones, intersect a larger number of fractures, or to follow a complex structure. Data collected about the actual versus planned wellbore deviations as well as other readings that can include the azimuth (direction) of the deviation, the magnitude of the in-situ stresses, and the direction of the in-situ stresses may be categorized in this group.

The drill string vibrations category 260 includes data collected regarding vibrations on the drill strings at various well sites. A drill string is a column, or string, of drill pipe that transmits drilling fluid and torque to the drill bit. As such, a drill string is an extremely slender structure, and because the string has a smaller diameter than the borehole, it is free to vibrate laterally, axially, and torsionally. One cause of lateral vibrations may be out of balance forces in the drill collars, resulting in a whirling motion, just as in an unbalanced centrifuge. Another cause may be the friction between the rotating drill string and the borehole wall. Other types of drill string vibration include is torsional or rotational vibration. Additionally, vibration can also be observed when the drill string is not rotating. For example, when using a steerable mud motor in oriented mode longitudinal stick-slip friction can induce irregular vibrations. Data collected about drill string vibrations at well sites including hole patterns, bit failures, and bottom hole assembly (BHA) design may be categorized in this group.

Figure 3:
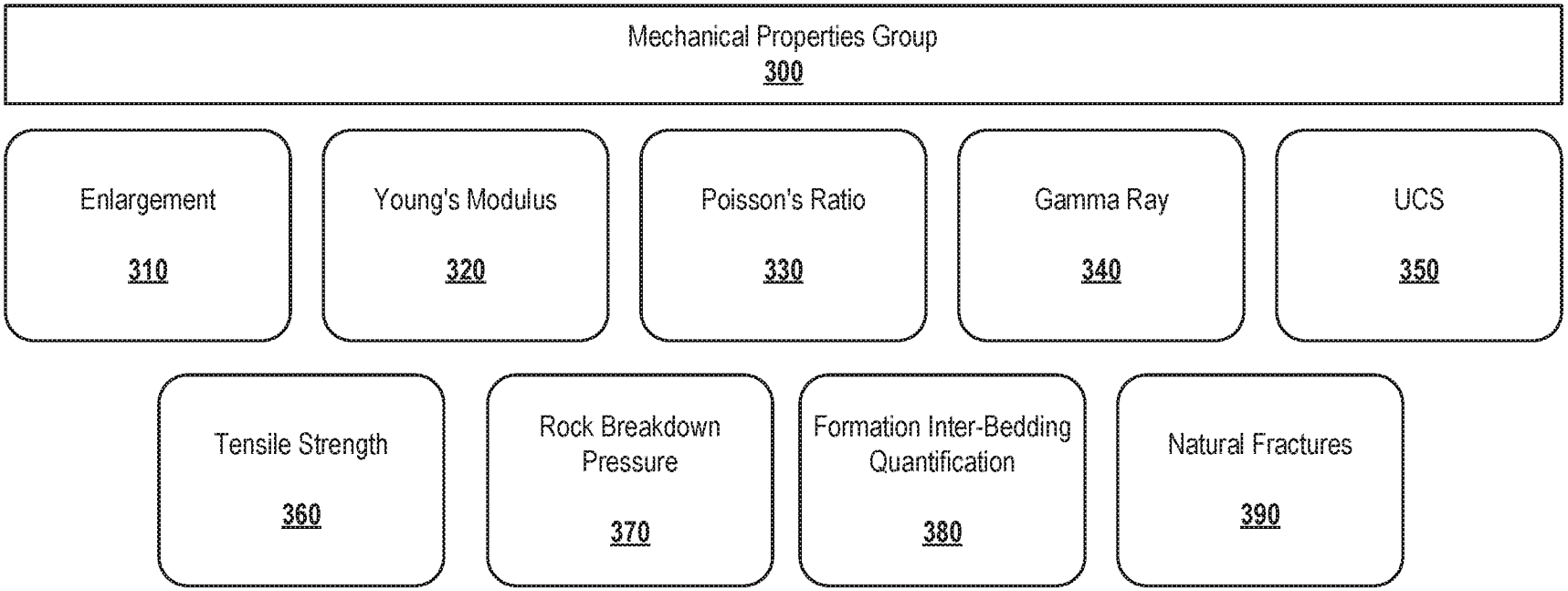
FIG. 3 illustrates a block diagram of information that can be clustered by the described wellbore stability system into the formation mechanical properties group.

FIG. 3 illustrates a block diagram of information that can be clustered by the described wellbore stability system into the formation mechanical properties group 300. The formation mechanical properties group 300 includes measurements taken from various well hole sites and includes categories for enlargement 310, Young's modulus 320, Poisson's Ratio 330, gamma ray 340, unconfined compressive strengths (UCS) 350, tensile strength 360, rock breakdown pressure 370, formation inter-bedding quantification 380, and natural fractures 390. In some implementations, an estimation of the information for the drilled formation mechanical properties group 300 is made based on logging data, which may be retrieved from a tool that is run into each wellbore (in most cases once only) after the completion of the drilling process. In some implementations, the logging data may be acquired in real-time while drilling through a Logging While Drilling (LWD) tool. The mechanical properties describe the control over the response of the drilled formation rock (in terms of enlargements or lack of) to the parameters included in the drilling fluid properties group 100 and the operational practices group 200. The readings of the formation mechanical properties may provide an indication of how the formation rock will respond to different disturbances and forces (such as reaming, and string vibrations). For example, a formation rock with a high UCS value will be expected to be less susceptible to enlargements than a formation with a low UCS when they are subjected to the same forces.

The contribution of each parameter from drilling fluids properties group 100, operational practices group 200, and formation mechanical properties group 300 is determined based on an analysis of the produced global plots and compiled data. The determination process can be performed in two parts. First, each parameter is examined for skewing of the extent of enlargements in the global field plots. Second, a correlation model is generated to quantify the correlation between the enlargement and each factor in the groups.

In some implementations, the correlation model includes a least-squares regression, which may include a multivariate linear regression where a value is assigned to signify the weight of each factor. This weight can then be calibrated using, for example, the trends observed in the global plots and based on other operational considerations. The employed least-squares regression may also include a multivariate nonlinear regression that identifies trends and correlation between the enlargement and each factor in the groups. The identified trends and correlations can then be represented in an equation. Such an equation may have coefficients assigned to each factor, which can be used to calculate enlargement.

In some implementations, the correlation model includes a logistic regression that is used to estimate discrete values, such as binary values that are based on a set of independent variables. Example binary values for the algorithm may include 0/1, failure/no failure, enlargement/no enlargement, and so forth. In some examples, the logistic regression predicts the probability of occurrence of wellbore failure by fitting data to a logit function.

In some implementations, the correlation model includes a decision tree, which may include a supervised learning algorithm to classification problems and data. A decision tree works for both categorical and continuous dependent variables. In some examples, populations are clustered into three homogeneous.

In some implementations, the correlation model includes a support vector machine (SVM), which plots each data item as a point in n-dimensional space, where n represents features. In such implementations, the value of each feature is the value of a particular coordinate.

In some implementations, the correlation model includes, a Naive Bayes classifier based on Bayes' theorem with an assumption of independence between predictors, for example, the factors in the three groups. A Naive Bayes classifier assumes that the presence of a particular feature in a class is unrelated to the presence of any other feature. For example, a drilling fluid may be considered to cause enlargement if it has low mud weight, high viscosity, and a high gel strength. Even if these features depend on each other or upon the existence of the other features, a naive Bayes classifier would consider all of these properties to independently contribute to the probability that this drilling fluid will cause enlargement.

In some implementations, the correlation model includes, a k-nearest neighbors (kNN) algorithm, which can be used for both classification and regression problems. A k-nearest neighbors algorithm stores available cases and classifies new cases by a majority vote of its k neighbors. The case being assigned to the class that is most common amongst its k nearest neighbors measured by a distance function. Such distance functions can include Euclidean, Manhattan, Minkowski, and Hamming distance. The first three of these functions (Euclidean, Manhattan, Minkowski) are used for continuous function. The fourth of these functions (Hamming) is used for categorical variables.

In some implementations, the correlation model includes, a k-means algorithm, which is a type of unsupervised algorithm that solves the clustering problem. A k-means algorithm may provide a way to classify a given data set through a certain number of clusters, such as the three clusters or groups described in FIGS. 1-3 with each cluster having a separate sub-clusters for each factor described previously. Data points inside a cluster are homogeneous and heterogeneous to peer groups. In some implementations, a k-means algorithm forms cluster as follows: 1) k-means picks k number of points for each known cluster, for example, drilling fluids mud weight, as centroids; 2) each centroid mud weight data point forms a cluster with the closest centroids; 3) finds the centroid of each cluster based on existing cluster members; 4.) for new centroids, repeat step 2 and 3 to find the closest distance for each data point from new centroids and to associated with new k-clusters. The process repeats until convergence occurs, such as when centroids no longer change.

A k-means algorithm may include clusters. Each cluster can include its own centroid. The sum of the square of a difference between a centroid and the data points within a cluster constitutes a within sum of square value for that cluster. Also, when the sum of square values for all the clusters are added, it becomes total within sum of square value for the cluster solution.

In some implementations, the correlation model includes other algorithms, such as dimensionality reduction algorithms and gradient boosting algorithms (GBMs). Each of the previously described algorithms that can be included in the correlation model for the determination process identify trends and correlation between the enlargement and each factor in the groups (drilling fluids properties group 100, operational practices group 200, and formation mechanical properties group 300). These trends and correlations may be represented in the form of an equation that has coefficients assigned to each factor that can be used to calculate enlargement.

In some implementations. the specific algorithms employed within the correlation model is dependent on the validation process performed using offset wells (old wells) data. For example, when the determination process is employed for a new field or formation, off wells data may be gathered as described. The gathered data can then be employed in a trial and error process to select the most appropriate numerical or statistical analysis. For example, the most appropriate analysis may generate a more accurate prediction of the wellbore failure/enlargement with the gathered data. Therefore, the numerical or statistical analysis to be used can be decided based on its performance in the validation phase as it is the phase where both the input data and the actual output data is available to judge, for example, accuracy.

In some implementations, taking into account the clustered information described with regard to FIG. 1-3, a correlation model is built in two stages. In a first stage, parameters are clustered in each one of the three groups: drilling fluids properties group 100, operational practices group 200, and formation mechanical properties group 300. This clustering may be achieved using, for example, statistical, numerical, data analytics, or artificial intelligence techniques. Examples of such techniques include, but are not limited to, multivariate linear regression and artificial neural networks. As an example, the parameters in group one, such as drilling fluids, as a whole may be used as independent parameters (predictors) to predict the wellbore enlargement by applying a multivariate linear regression to the independent parameters. The same process may also be performed on the other two groups (operational practices and mechanical properties). The outcome of this stage, stage one, of the correlation model is a separate prediction of enlargements for each group. In stage two, the same technique is applied with the three predictions of enlargement as the independent parameters (predictors) and the final estimated enlargement as the output. Comparing the actual enlargement experienced for each well against that predicted by the model can be used as the mean to assign weights to each group.

Figure 4:
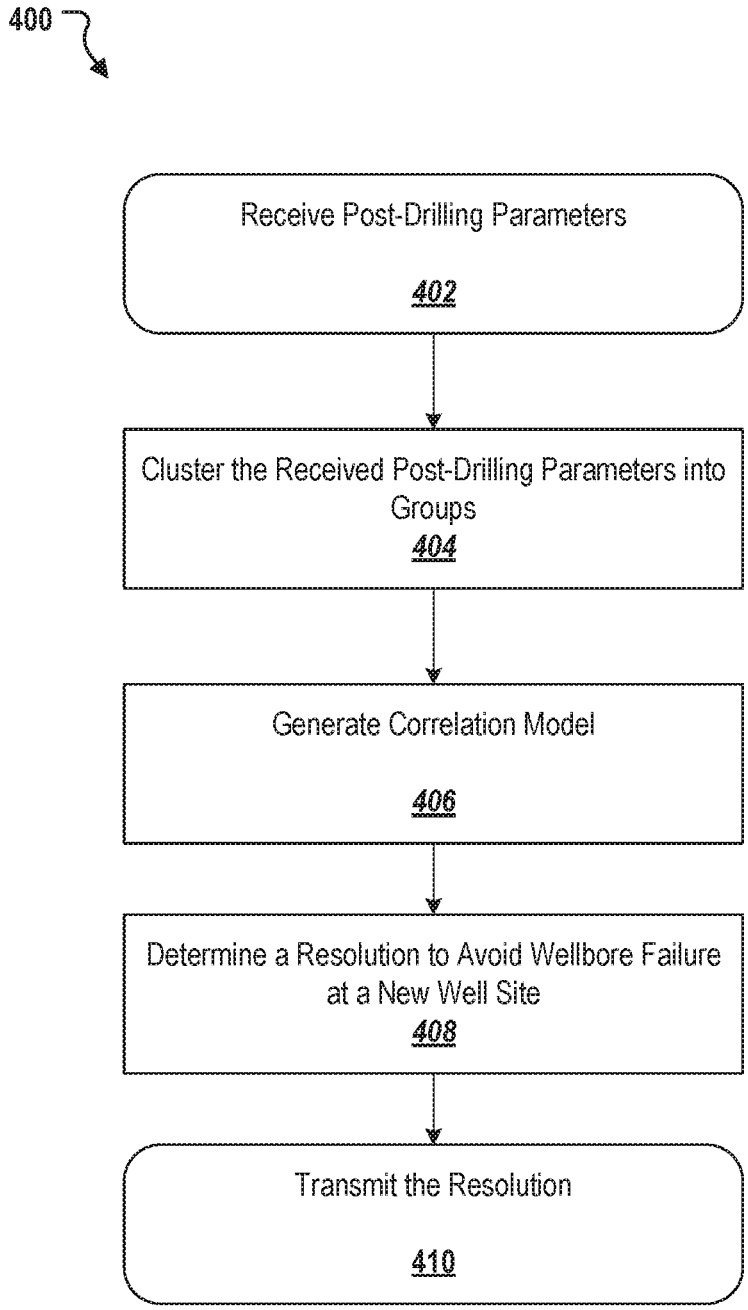
FIG. 4 illustrates a flow diagram of an example process of the wellbore stability system.

FIG. 4 illustrates a flow diagram of an example process 400 of the wellbore stability system. For clarity of presentation, the description that follows generally describes the process 400 in the context of FIGS. 1, 2, 3, and 5. However, it will be understood that process 400 may be performed, for example, by any other suitable system, environment, software, and hardware, or a combination of systems, environments, software, and hardware as appropriate. In some implementations, various steps of the process 400 can be run in parallel, in combination, in loops, or in any order.

The process 400 describes generally the validation and the building of a model using offset wells data. The model can be employed to predict the extent of wellbore failure and enlargement for new wells based. The input data for new wells includes the three groups described previously: drilling fluids properties group 100, operational practices group 200, and formation mechanical properties group 300. In some implementations, only the formation mechanical properties are uncontrollable. Therefore, based on the generated model, the system can issue specific recommendations to adjust the different factors under the first two groups to manage and predict wellbore failure and enlargement.

At 402, post-drilling information for a well site is received. The post drilling information may include drilling-fluid data, operational-parameter data, and formation-property data as described above in FIG. 1-3. From 402, the process 400 proceeds to 404. At 404, each data element of the respective drilling-fluid data, operational-parameter data, and formation-property data is clustered into groups based on an information type of each post-drilling parameter. The data elements can include the information such as described in FIGS. 1-3. For example, the drilling-fluid data may contain data elements for periodic drilling fluid readings, shale inhibition readings, mud rheology readings, mud filtrate readings, and mud salt concertation readings form the well site (110-150 of FIG. 1). As another example, the operational-parameter data may contain data elements for failure time dependencies readings, drilling parameters, reaming readings, swabbing readings, wellbore deviation readings, and drill string vibrations readings from the well site (210-260 of FIG. 2). As yet another example, the formation-property data may contain data elements for from the well site, such as categories for enlargement, Young's modulus, Poisson's Ratio, gamma ray, UCS, tensile strength, rock breakdown pressure, formation inter-bedding quantification, and natural fractures (310-390 of FIG. 3). From 404, the process 400 proceeds to 406.

At 406, a correlation model is generated by applying statistical analysis, such as a multivariate linear regression, to the post-drilling parameters included in each of the groups. The correlation model can be generated based on a prediction of enlargement determined according to a group correlation model generated for each of the groups based on the statistical analysis applied to the post-drilling parameters included in each of the groups. In some implementations, each of the group correlation models includes weighed values assigned to each of the post-drilling parameters included in each of the respective groups. These weighed values may be determined, for example, based on an actual enlargement experienced at the well site compared to the predictions of enlargement determined according to each of the group correlation models. For example, categories with data elements for drilling-fluid data may be weighted respective to each other according to the influence indicator 160 of FIG. 1, where the influence indicator is determined based on an actual enlargement as compared to the predictions of enlargement for the well site. Likewise, the categories with data elements for operational-parameter data, and formation-property data may be weighted respective to each other according to the influence indicators 260 and 360 of FIGS. 2 and 3 respectively. From 406, the process 400 proceeds to 408.

At 408, a resolution to avoid wellbore failure at a new well site is determined by processing information regarding the new well site through the correlation model. From 408, the process 400 proceeds to 410.

At 410, the resolution is transmitted for implementation at the well site. The resolution may include cutoff values and thresholds for critical parameters, such as specification for drilling fluid and operational practice adjustments, at the new well site. From 410, the process 400 ends.

Figure 5:
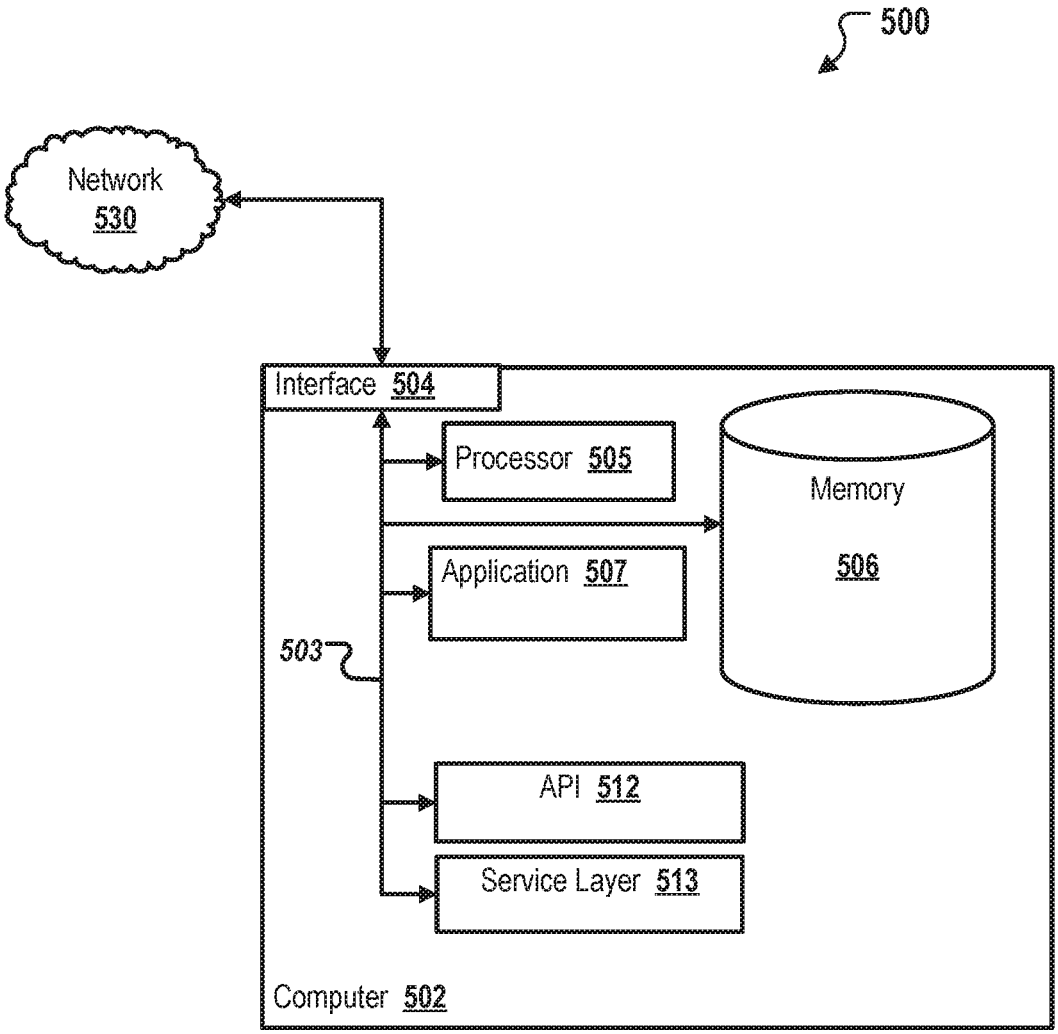
FIG. 5 illustrates a block diagram of an exemplary computer system used to provide computational functionalities associated with described algorithms, methods, functions, processes, flows, and procedures as described in the instant disclosure, according to an implementation.

FIG. 5 illustrates a block diagram of an exemplary computer system 500 used to provide computational functionalities associated with described algorithms, methods, functions, processes, flows, and procedures as described in the instant disclosure, according to an implementation. The illustrated computer 502 is intended to encompass any computing device such as a server, desktop computer, laptop or notebook computer, wireless data port, smart phone, personal data assistant (PDA), tablet computing device, one or more processors within these devices, or any other suitable processing device, including both physical or virtual instances (or both) of the computing device. Additionally, the computer 502 may comprise a computer that includes an input device, such as a keypad, keyboard, touch screen, or other device that can accept user information, and an output device that conveys information associated with the operation of the computer 502, including digital data, visual, or audio information (or a combination of information), or a graphical user interface (GUI).

The computer 502 can serve in a role as a client, network component, a server, a database or other persistency, or any other component (or a combination of roles) of a computer system for performing the subject matter described in the instant disclosure. The illustrated computer 502 is communicably coupled with a network 530. In some implementations, one or more components of the computer 502 may be configured to operate within environments, including cloud-computing-based, local, global, or other environment (or a combination of environments).

At a high level, the computer 502 is an electronic computing device operable to receive, transmit, process, store, or manage data and information associated with the described subject matter. According to some implementations, the computer 502 may also include or be communicably coupled with an application server, e-mail server, web server, caching server, streaming data server, business intelligence (BI) server, or other server (or a combination of servers).

The computer 502 can receive requests over network 530 from a client application (for example, executing on another computer 502) and responding to the received requests by processing the said requests in an appropriate software application. In addition, requests may also be sent to the computer 502 from internal users (for example, from a command console or by other appropriate access method), external or third parties, other automated applications, as well as any other appropriate entities, individuals, systems, or computers.

Each of the components of the computer 502 can communicate using a system bus 503. In some implementations, any or all of the components of the computer 502, both hardware or software (or a combination of hardware and software), may interface with each other or the interface 504 (or a combination of both) over the system bus 503 using an application programming interface (API) 512 or a service layer 513 (or a combination of the API 512 and service layer 513). The API 512 may include specifications for routines, data structures, and object classes. The API 512 may be either computer-language independent or dependent and refer to a complete interface, a single function, or even a set of APIs. The service layer 513 provides software services to the computer 502 or other components (whether or not illustrated) that are communicably coupled to the computer 502. The functionality of the computer 502 may be accessible for all service consumers using this service layer. Software services, such as those provided by the service layer 513, provide reusable, defined business functionalities through a defined interface. For example, the interface may be software written in JAVA, C++, or other suitable language providing data in extensible markup language (XML) format or other suitable format. While illustrated as an integrated component of the computer 502, alternative implementations may illustrate the API 512 or the service layer 513 as stand-alone components in relation to other components of the computer 502 or other components (whether or not illustrated) that are communicably coupled to the computer 502. Moreover, any or all parts of the API 512 or the service layer 513 may be implemented as child or sub-modules of another software module, enterprise application, or hardware module without departing from the scope of this disclosure.

The computer 502 includes an interface 504. Although illustrated as a single interface 504 in FIG. 5, two or more interfaces 504 may be used according to particular needs, desires, or particular implementations of the computer 502. The interface 504 is used by the computer 502 for communicating with other systems in a distributed environment that are connected to the network 530 (whether illustrated or not). Generally, the interface 504 comprises logic encoded in software or hardware (or a combination of software and hardware) and operable to communicate with the network 530. More specifically, the interface 504 may comprise software supporting one or more communication protocols associated with communications such that the network 530 or interface's hardware is operable to communicate physical signals within and outside of the illustrated computer 502.

The computer 502 includes a processor 505. Although illustrated as a single processor 505 in FIG. 5, two or more processors may be used according to particular needs, desires, or particular implementations of the computer 502. Generally, the processor 505 executes instructions and manipulates data to perform the operations of the computer 502 and any algorithms, methods, functions, processes, flows, and procedures as described in the instant disclosure.

The computer 502 also includes a memory 506 that holds data for the computer 502 or other components (or a combination of both) that can be connected to the network 530 (whether illustrated or not). For example, memory 506 can be a database storing data consistent with this disclosure. Although illustrated as a single memory 506 in FIG. 5, two or more memories may be used according to particular needs, desires, or particular implementations of the computer 502 and the described functionality. While memory 506 is illustrated as an integral component of the computer 502, in alternative implementations, memory 506 can be external to the computer 502.

The application 507 is an algorithmic software engine providing functionality according to particular needs, desires, or particular implementations of the computer 502, particularly with respect to functionality described in this disclosure. For example, application 507 can serve as one or more components, modules, applications, etc. Further, although illustrated as a single application 507, the application 507 may be implemented as multiple applications 507 on the computer 502. In addition, although illustrated as integral to the computer 502, in alternative implementations, the application 507 can be external to the computer 502.

There may be any number of computers 502 associated with, or external to, a computer system containing computer 502, each computer 502 communicating over network 530. Further, the term "client," "user," and other appropriate terminology may be used interchangeably as appropriate without departing from the scope of this disclosure. Moreover, this disclosure contemplates that many users may use one computer 502, or that one user may use multiple computers 502.

Described implementations of the subject matter can include one or more features, alone or in combination.

For example, in a first implementation, a computer-implemented method executed by one or more processors includes receiving, for a well site, post-drilling parameters; clustering the received post-drilling parameters into groups based on an information type of each post-drilling parameter; generating a correlation model by applying a numerical analysis or a statistical analysis to the post-drilling parameters included in each of the groups; determining a resolution to avoid wellbore failure at a new well site by processing information regarding the new well site through the correlation model; and transmitting the resolution for implementation at the well site The foregoing and other described implementations can each optionally include one or more of the following features.

A first feature, combinable with any of the following features, the correlation model is generated base on a prediction of enlargement determined according to a group correlation model generated for each of the groups based on the statistical analysis applied to the post-drilling parameters included in each of the groups.

A second feature, combinable with any of the previous or following features, each of the group correlation models includes weighed values assigned to each of the post-drilling parameters included in each of the respective groups.

A third feature, combinable with any of the previous or following features, the weighed values are determined based on an actual enlargement experienced at the well site compared to the predictions of enlargement determined according to each of the group correlation models.

A fourth feature, combinable with any of the previous or following features, the weighed values reflect an amount of influence each of the respective post-drilling parameters has on wellbore failure respective to the other post-drilling parameters included in the same group.

A fifth feature, combinable with any of the previous or following features, the groups include a drilling-fluid data group, an operational-parameter data group, and a mechanical-property data group.

A sixth feature, combinable with any of the previous or following features, the post-drilling parameters clustered into the drilling-fluid data group include periodic drilling fluid readings, shale inhibition readings, mud rheology readings, mud filtrate readings, and mud salt concertation readings from the well site.

A seventh feature, combinable with any of the previous or following features, the post-drilling parameters clustered into the operational-parameter data group include failure time dependencies readings, reaming readings, swabbing readings, wellbore deviation readings, and drill string vibrations readings from the well site.

An eighth feature, combinable with any of the previous or following features, the statistical analysis includes applying a multivariate linear regression to the post-drilling parameters included in each of the groups A ninth feature, combinable with any of the previous or following features, the new well site and the well site are the same well site, the resolution for implementation at the well site is transmitted in real-time, and determining the resolution includes identifying root causes for wellbore failure, hole enlargement, and poor hole conditions at the well site is based on the correlation model.

A tenth feature, combinable with any of the previous or following features, the resolution includes cutoff values and thresholds for critical parameters at the new well site, and wherein the critical parameters include specification for drilling fluid and operational practice adjustments.

In a second implementation, one or more non-transitory computer-readable storage media coupled to one or more processors and having instructions stored thereon which, when executed by the one or more processors, cause the one or more processors to perform operations comprising: receiving, for a well site, post-drilling parameters; clustering the received post-drilling parameters into groups based on an information type of each post-drilling parameter; generating a correlation model by applying a numerical analysis or a statistical analysis to the post-drilling parameters included in each of the groups; determining a resolution to avoid wellbore failure at a new well site by processing information regarding the new well site through the correlation model; and transmitting the resolution for implementation at the well site.

The foregoing and other described implementations can each optionally include one or more of the following features.

A first feature, combinable with any of the following features, the correlation model is generated base on a prediction of enlargement determined according to a group correlation model generated for each of the groups based on the statistical analysis applied to the post-drilling parameters included in each of the groups.

A second feature, combinable with any of the previous or following features, each of the group correlation models includes weighed values assigned to each of the post-drilling parameters included in each of the respective groups.

A third feature, combinable with any of the previous or following features, the weighed values are determined based on an actual enlargement experienced at the well site compared to the predictions of enlargement determined according to each of the group correlation models.

A fourth feature, combinable with any of the previous or following features, the weighed values reflect an amount of influence each of the respective post-drilling parameters has on wellbore failure respective to the other post-drilling parameters included in the same group.

A fifth feature, combinable with any of the previous or following features, the groups include a drilling-fluid data group, an operational-parameter data group, and a mechanical-property data group.

A sixth feature, combinable with any of the previous or following features, the post-drilling parameters clustered into the drilling-fluid data group include periodic drilling fluid readings, shale inhibition readings, mud rheology readings, mud filtrate readings, and mud salt concertation readings from the well site.

A seventh feature, combinable with any of the previous or following features, the post-drilling parameters clustered into the operational-parameter data group include failure time dependencies readings, reaming readings, swabbing readings, wellbore deviation readings, and drill string vibrations readings from the well site.

An eighth feature, combinable with any of the previous or following features, the statistical analysis includes applying a multivariate linear regression to the post-drilling parameters included in each of the groups A ninth feature, combinable with any of the previous or following features, the new well site and the well site are the same well site, the resolution for implementation at the well site is transmitted in real-time, and determining the resolution includes identifying root causes for wellbore failure, hole enlargement, and poor hole conditions at the well site is based on the correlation model.

A tenth feature, combinable with any of the previous or following features, the resolution includes cutoff values and thresholds for critical parameters at the new well site, and wherein the critical parameters include specification for drilling fluid and operational practice adjustments.

In a third implementation, a computer-implemented system, comprising: one or more processors; and a computer-readable storage device coupled to the one or more processors and having instructions stored thereon which, when executed by the one or more processors, cause the one or more processors to perform operations comprising: receiving, for a well site, post-drilling parameters; clustering the received post-drilling parameters into groups based on an information type of each post-drilling parameter; generating a correlation model by applying a numerical analysis or a statistical analysis to the post-drilling parameters included in each of the groups; determining a resolution to avoid wellbore failure at a new well site by processing information regarding the new well site through the correlation model; and transmitting the resolution for implementation at the well site.

The foregoing and other described implementations can each optionally include one or more of the following features.

A first feature, combinable with any of the following features, the correlation model is generated base on a prediction of enlargement determined according to a group correlation model generated for each of the groups based on the statistical analysis applied to the post-drilling parameters included in each of the groups.

A second feature, combinable with any of the previous or following features, each of the group correlation models includes weighed values assigned to each of the post-drilling parameters included in each of the respective groups.

A third feature, combinable with any of the previous or following features, the weighed values are determined based on an actual enlargement experienced at the well site compared to the predictions of enlargement determined according to each of the group correlation models.

A fourth feature, combinable with any of the previous or following features, the weighed values reflect an amount of influence each of the respective post-drilling parameters has on wellbore failure respective to the other post-drilling parameters included in the same group.

A fifth feature, combinable with any of the previous or following features, the groups include a drilling-fluid data group, an operational-parameter data group, and a mechanical-property data group.

A sixth feature, combinable with any of the previous or following features, the post-drilling parameters clustered into the drilling-fluid data group include periodic drilling fluid readings, shale inhibition readings, mud rheology readings, mud filtrate readings, and mud salt concertation readings from the well site.

A seventh feature, combinable with any of the previous or following features, the post-drilling parameters clustered into the operational-parameter data group include failure time dependencies readings, reaming readings, swabbing readings, wellbore deviation readings, and drill string vibrations readings from the well site.

An eighth feature, combinable with any of the previous or following features, the statistical analysis includes applying a multivariate linear regression to the post-drilling parameters included in each of the groups A ninth feature, combinable with any of the previous or following features, the new well site and the well site are the same well site, the resolution for implementation at the well site is transmitted in real-time, and determining the resolution includes identifying root causes for wellbore failure, hole enlargement, and poor hole conditions at the well site is based on the correlation model.

A tenth feature, combinable with any of the previous or following features, the resolution includes cutoff values and thresholds for critical parameters at the new well site, and wherein the critical parameters include specification for drilling fluid and operational practice adjustments.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Implementations of the subject matter described in this specification can be implemented as one or more computer programs, that is, one or more modules of computer program instructions encoded on a tangible, non-transitory, computer-readable computer-storage medium for execution by, or to control the operation of, data processing apparatus. Alternatively or in addition, the program instructions can be encoded on an artificially generated propagated signal, for example, a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," or "electronic computer device" (or equivalent as understood by one of ordinary skill in the art) refer to data processing hardware and encompass all kinds of apparatus, devices, and machines for processing data, including by way of example, a programmable processor, a computer, or multiple processors or computers. The apparatus can also be or further include special purpose logic circuitry, for example, a central processing unit (CPU), a field programmable gate array (FPGA), or an application-specific integrated circuit (ASIC). In some implementations, the data processing apparatus or special purpose logic circuitry (or a combination of the data processing apparatus or special purpose logic circuitry) may be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, IOS or any other suitable conventional operating system.

A computer program, which may also be referred to or described as a program, software, a software application, a module, a software module, a script, or code, can be written in any form of programming language, including compiled or interpreted languages, or declarative or procedural languages, and it can be deployed in any form, including as a stand-alone program or as a module, component, subroutine, or other unit suitable for use in a computing environment. A computer program may, but need not, correspond to a file in a file system. A program can be stored in a portion of a file that holds other programs or data, for example, one or more scripts stored in a markup language document, in a single file dedicated to the program in question, or in multiple coordinated files, for example, files that store one or more modules, sub-programs, or portions of code. A computer program can be deployed to be executed on one computer or on multiple computers that are located at one site or distributed across multiple sites and interconnected by a communication network. While portions of the programs illustrated in the various figures are shown as individual modules that implement the various features and functionality through various objects, methods, or other processes, the programs may instead include a number of sub-modules, third-party services, components, libraries, and such, as appropriate. Conversely, the features and functionality of various components can be combined into single components as appropriate.

The processes and logic flows described in this specification can be performed by one or more programmable computers executing one or more computer programs to perform functions by operating on input data and generating output. The processes and logic flows can also be performed by, and apparatus can also be implemented as, special purpose logic circuitry, for example, a CPU, an FPGA, or an ASIC.

Computers suitable for the execution of a computer program can be based on general or special purpose microprocessors, both, or any other kind of CPU. Generally, a CPU will receive instructions and data from a read-only memory (ROM) or a random access memory (RAM) or both. The essential elements of a computer are a CPU for performing or executing instructions and one or more memory devices for storing instructions and data. Generally, a computer will also include, or be operatively coupled to, receive data from or transfer data to, or both, one or more mass storage devices for storing data, for example, magnetic, magneto-optical disks, or optical disks. However, a computer need not have such devices. Moreover, a computer can be embedded in another device, for example, a mobile telephone, a personal digital assistant (PDA), a mobile audio or video player, a game console, a global positioning system (GPS) receiver, or a portable storage device, for example, a universal serial bus (USB) flash drive, to name just a few.

Computer-readable media (transitory or non-transitory, as appropriate) suitable for storing computer program instructions and data include all forms of non-volatile memory, media and memory devices, including by way of example semiconductor memory devices, for example, erasable programmable read-only memory (EPROM), electrically erasable programmable read-only memory (EEPROM), and flash memory devices; magnetic disks, for example, internal hard disks or removable disks; magneto-optical disks; and compact disc (CD)-ROM, digital versatile disc (DVD) +/-R, DVD-RAM, and DVD-ROM disks. The memory may store various objects or data, including caches, classes, frameworks, applications, backup data, jobs, web pages, web page templates, database tables, repositories storing dynamic information, and any other appropriate information including any parameters, variables, algorithms, instructions, rules, constraints, or references thereto. Additionally, the memory may include any other appropriate data, such as logs, policies, security or access data, reporting files, as well as others. The processor and the memory can be supplemented by, or incorporated in, special purpose logic circuitry.

To provide for interaction with a user, implementations of the subject matter described in this specification can be implemented on a computer having a display device, for example, a cathode ray tube (CRT), liquid crystal display (LCD), light-emitting diode (LED), or plasma monitor, for displaying information to the user and a keyboard and a pointing device, for example, a mouse, trackball, or trackpad by which the user can provide input to the computer. Input may also be provided to the computer using a touchscreen, such as a tablet computer surface with pressure sensitivity, a multi-touch screen using capacitive or electric sensing, or other type of touchscreen. Other kinds of devices can be used to provide for interaction with a user as well; for example, feedback provided to the user can be any form of sensory feedback, for example, visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

The term GUI may be used in the singular or the plural to describe one or more graphical user interfaces and each of the displays of a particular graphical user interface. Therefore, a GUI may represent any graphical user interface, including but not limited to, a web browser, a touch screen, or a command line interface (CLI) that processes information and efficiently presents the information results to the user. In general, a GUI may include a plurality of user interface (UI) elements, some or all associated with a web browser, such as interactive fields, pull-down lists, and buttons operable by the business suite user. These and other UI elements may be related to or represent the functions of the web browser.

Implementations of the subject matter described in this specification can be implemented in a computing system that includes a back-end component, for example, as a data server, or that includes a middleware component, for example, an application server, or that includes a front-end component, for example, a client computer having a graphical user interface or a Web browser through which a user can interact with an implementation of the subject matter described in this specification, or any combination of one or more such back-end, middleware, or front-end components. The components of the system can be interconnected by any form or medium of wireline or wireless digital data communication (or a combination of data communication), for example, a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) using, for example, 802.11 a/b/g/n or 802.20 (or a combination of 802.11x and 802.20 or other protocols consistent with this disclosure), all or a portion of the Internet, or any other communication system or systems at one or more locations (or a combination of communication networks). The network may communicate with, for example, Internet Protocol (IP) packets, Frame Relay frames, Asynchronous Transfer Mode (ATM) cells, voice, video, data, or other suitable information (or a combination of communication types) between network addresses.

The computing system can include clients and servers. A client and server are generally remote from each other and typically interact through a communication network. The relationship of client and server arises by virtue of computer programs running on the respective computers and having a client-server relationship to each other.

In some implementations, any or all of the components of the computing system, both hardware or software (or a combination of hardware and software), may interface with each other or the interface using an API or a service layer (or a combination of API and service layer). The API may include specifications for routines, data structures, and object classes. The API may be either computer language independent or dependent and refer to a complete interface, a single function, or even a set of APIs. The service layer provides software services to the computing system. The functionality of the various components of the computing system may be accessible for all service consumers using this service layer. Software services provide reusable, defined business functionalities through a defined interface. For example, the interface may be software written in JAVA, C++, or other suitable language providing data in XML format or other suitable format. The API or service layer (or a combination of the API and the service layer) may be an integral or a stand-alone component in relation to other components of the computing system. Moreover, any or all parts of the service layer may be implemented as child or sub-modules of another software module, enterprise application, or hardware module without departing from the scope of this disclosure.

While this specification contains many specific implementation details, these should not be construed as limitations on the scope of any invention or on the scope of what may be claimed, but rather as descriptions of features that may be specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described earlier as acting in certain combinations and even initially claimed as such, one or more features from a claimed combination can in some cases be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the implementations described earlier should not be understood as requiring such separation or integration in all implementations, and it should be understood that the described program components and systems can generally be integrated together in a single software product or packaged into multiple software products.

Accordingly, the earlier description of example implementations does not define or constrain this disclosure. Other changes, substitutions, and alterations are also possible without departing from the spirit and scope of this disclosure.

Furthermore, any claimed implementation later described is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

What is claimed is:

1. A computer-implemented method executed by one or more processors, the method comprising:

receiving, for a well site, post-drilling parameters;

clustering the received post-drilling parameters into a first group and a second group based on an information type of each post-drilling parameter, wherein the first group includes a first post-drilling parameter with a first weight and a second post-drilling parameter with a second weight, and wherein the second group includes a third post-drilling parameter with a third weight and a fourth post-drilling parameter with a fourth weight;

generating a correlation model by applying a numerical analysis or a statistical analysis to the post-drilling parameters included in each of the first group and the second group based on the parameters and the first, second, third, and fourth weights;

determining a resolution to avoid wellbore failure at a new well site by processing information regarding the new well site through the correlation model;

implementing the resolution as a threshold value of a drilling parameter at the new well site; and drilling, at the new well site, based on the threshold value.

2. The method of claim 1, wherein the correlation model is generated based on a prediction of enlargement determined according to a group correlation model generated for each of the first group and the second group based on the statistical analysis applied to the post-drilling parameters included in each of the first group and the second.

3. The method of claim 2, wherein the weighted values are determined based on an actual enlargement experienced at the well site compared to the predictions of enlargement determined according to each of the group correlation models.

4. The method of claim 2, wherein the weighted values reflect an amount of influence each of the respective post-drilling parameters has on wellbore failure respective to the other post-drilling parameters included in the same group.

5. The method of claim 1, wherein the first group is one of a drilling-fluid data group, an operational-parameter data group, and a mechanical-property data group.

6. The method of claim 5, wherein the post-drilling parameters clustered into the drilling-fluid data group include periodic drilling fluid readings, shale inhibition readings, mud rheology readings, mud filtrate readings, and mud salt concertation readings from the well site.

7. The method of claim 5, wherein the post-drilling parameters clustered into the operational-parameter data group include failure time dependencies readings, reaming readings, swabbing readings, wellbore deviation readings, and drill string vibrations readings from the well site.

8. The method of claim 1, wherein the statistical analysis includes applying a multivariate linear regression to the post-drilling parameters included in each of the first group and the second group.

9. The method of claim 1, wherein the new well site and the well site are the same well site, wherein the resolution for implementation at the well site is transmitted in real-time, and wherein determining the resolution includes identifying root causes for wellbore failure, hole enlargement, and poor hole conditions at the well site based on the correlation model.

10. The method of claim 1, where in the resolution includes cutoff values and thresholds for critical parameters at the new well site, and wherein the critical parameters include specification for drilling fluid and operational practice adjustments.

11. One or more non-transitory computer-readable storage media coupled to one or more processors and having instructions stored thereon which, when executed by the one or more processors, cause the one or more processors to perform operations comprising:

receiving, for a well site, post-drilling parameters;

clustering the received post-drilling parameters into a first group and a second group based on an information type of each post-drilling parameter, wherein the first group includes a first post-drilling parameter with a first weight and a second post-drilling parameter with a second weight, and wherein the second group includes a third post-drilling parameter with a third weight and a fourth post-drilling parameter with a fourth weight;

generating a correlation model by applying a numerical analysis or a statistical analysis to the post-drilling parameters included in each of the first group and the second group based on the parameters and the first, second, third, and fourth weights;

determining a resolution to avoid wellbore failure at a new well site by processing information regarding the new well site through the correlation model;

implementing the resolution as a threshold value of a drilling parameter at the new well site; and drilling, at the new well site, based on the threshold value.

12. The one or more non-transitory computer-readable storage media of claim 11, wherein the statistical analysis includes applying a multivariate linear regression to the post-drilling parameters included in each of the first group and the second group.

13. The one or more non-transitory computer-readable storage media of claim 11, wherein the first group is one of a drilling-fluid data group, an operational-parameter data group, and a mechanical-property data group, and the second group is another of the drilling-fluid data group, the operational-parameter data group, and the mechanical-property data group.

14. The one or more non-transitory computer-readable storage media of claim 13, wherein the post-drilling parameters clustered into the drilling-fluid data group include periodic drilling fluid readings, shale inhibition readings, mud rheology readings, mud filtrate readings, and mud salt concertation readings from the well site, and wherein the post-drilling parameters clustered into the operational-parameter data group include failure time dependencies readings, reaming readings, swabbing readings, wellbore deviation readings, and drill string vibrations readings from the well site.

15. A computer-implemented system, comprising:

one or more processors; and a computer-readable storage device coupled to the one or more processors and having instructions stored thereon which, when executed by the one or more processors, cause the one or more processors to perform operations comprising:

receiving, for a well site, post-drilling parameters;

clustering the received post-drilling parameters into a first group and a second group based on an information type of each post-drilling parameter, wherein the first group includes a first post-drilling parameter with a first weight and a second post-drilling parameter with a second weight, and wherein the second group includes a third post-drilling parameter with a third weight and a fourth post-drilling parameter with a fourth weight;

generating a correlation model by applying a numerical analysis or a statistical analysis to the post-drilling parameters included in each of the groups based on parameters and the first, second, third, and fourth weights;

determining a resolution to avoid wellbore failure at a new well site by processing information regarding the new well site through the correlation model; and implementing the resolution as a threshold value of a drilling parameter at the new well site; and drilling, at the new well site, based on the threshold value.

16. The computer-implemented system of claim 15, wherein the correlation model is generated base on a prediction of enlargement determined according to a group correlation model generated for each of the first group and the second group based on the statistical analysis applied to the post-drilling parameters included in each of the first group and the second group.

17. The computer-implemented system of claim 16, wherein the weighted values are determined based on an actual enlargement experienced at the well site compared to the predictions of enlargement determined according to each of the group correlation models.

18. The computer-implemented system of claim 17, wherein the weighted values reflect an amount of influence each of the respective post-drilling parameters has on wellbore failure respective to the other post-drilling parameters included in the same group.

19. The computer-implemented method of claim 1, wherein the drilling parameter is a drilling fluid parameter or an operational practice parameter of the new well site.

20. The computer-implemented system of claim 15, wherein the drilling parameter is a drilling fluid parameter or an operational practice parameter of the new well site.

* * * * *